US006530830B2

(12) United States Patent
Rich et al.

(10) Patent No.: US 6,530,830 B2
(45) Date of Patent: Mar. 11, 2003

(54) SANDING DISC

(75) Inventors: Larry D. Rich, Oakdale, MN (US); Galen A. Fitzel, St. Paul, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 127 days.

(21) Appl. No.: 09/812,266

(22) Filed: Mar. 19, 2001

(65) Prior Publication Data

US 2002/0132573 A1 Sep. 19, 2002

(51) Int. Cl.[7] ..... B23F 21/03

(52) U.S. Cl. ..... 451/548; 451/451; 451/550; 15/230

(58) Field of Search ..... 451/532–539, 451/548, 550; 15/230, 230.12, 230.14, 230.15, 230.16, 230.17, 230.18; 51/297, 293, 295

(56) References Cited

U.S. PATENT DOCUMENTS

| | | | | |
|---|---|---|---|---|
| 2,082,916 A | | 6/1937 | Stratford | |
| 2,298,318 A | | 10/1942 | Stratford | |
| 3,089,294 A | | 5/1963 | Cowley | |
| 4,782,632 A | | 11/1988 | Matechuk | |
| 5,138,735 A | | 8/1992 | Kusz et al. | |
| 5,239,783 A | | 8/1993 | Matechuk | |
| 5,690,545 A | | 11/1997 | Clowers et al. | |
| 6,081,959 A | | 7/2000 | Umbrell | |
| 6,190,246 B1 | * | 2/2001 | Parrott et al. | 451/540 |
| 6,227,959 B1 | * | 5/2001 | Beaudry | 451/526 |
| 6,368,202 B1 | * | 4/2002 | Kaiser | 451/548 |

FOREIGN PATENT DOCUMENTS

EP 0 727 281 A 8/1996

OTHER PUBLICATIONS

P. 70 from "Porter Cable Professional Power Tools" "2001–2002 Product Catalog" and related information in accompanying "Information Disclosure Statement".

Information concerning abrasive disc sold in 1959's and early 1960's in accompanying "Information Disclosure Statement".

* cited by examiner

*Primary Examiner*—George Nguyen
(74) *Attorney, Agent, or Firm*—William L. Huebsch

(57) ABSTRACT

A sanding disc particularly useful for smoothing drywall. The sanding disc includes a circular abrasive disc having an abrasive surface, and a circular foam disc smaller in diameter than the abrasive disc which is co-axially adhered to the surface of the abrasive disc opposite its abrasive surface. The abrasive disc has a circular central portion along which the surface defined by the abrasive is generally planar, and has an annular peripheral portion extending from its central portion to its peripheral surface along which its surface defined by the abrasive is generally cylindrically convex to position the peripheral surface of the abrasive disc in a plane passing through the foam disc.

8 Claims, 2 Drawing Sheets

SANDING DISC

FIELD OF THE INVENTION

The present invention relates to drywall compound sanding discs of the type comprising a polymeric foam disc and an abrasive disc having a diameter larger than that of the foam disc that is adhered to one major surface of the foam disc and includes a layer of abrasive material on its surface opposite the foam disc by which drywall compound may be sanded when the sanding disc is rotated by a drive motor while its abrasive surface is pressed against the drywall compound.

BACKGROUND OF THE INVENTION

Known in the art is a drywall compound sanding disc comprising a polymeric foam disc and an abrasive disc including a layer of abrasive material defining one major surface of the abrasive disc. The abrasive disc has a diameter larger than that of the foam disc and has its surface opposite the abrasive material co-axially adhered to one major surface of the foam disc. Such sanding discs may be used to sand drywall compound (i.e., the compound used to fill and cover the joints between the edges of adjacent sheets of drywall that are used to form the inner surfaces of rooms during the construction of houses, commercial buildings and the like) by rotating the sanding disc using a drive motor while the abrasive on the sanding disc is pressed against the drywall compound. One such drywall compound sanding disc is commercially available from Porter Cable Co., Professional Power Tools, Jackson, Tenn., and is adapted to be driven by the model 7800 Power Drywall compound sanding Tool also commercially available from Porter Cable, Professional Power Tools. While such drywall compound sanding discs driven by that tool can be used to effectively smooth dry wall compound, they present several problems. The major surface of the sanding disc defined by the layer of abrasive material is all generally planar so that the portion of the sanding disc adjacent to its peripheral edge has a tendency to gouge drywall compound to be smoothed if it is pressed against that dry wall compound with much of an angle between the surfaces of the drywall and the major surface of the sanding disc. Also, that peripheral edge of the sanding disc has a tendency to catch on projections above the surface of the drywall compound (e.g., electrical outlet boxes) which can tear the sanding disc and make it unsuitable for further use. Additionally, the portion of the abrasive disc on such a sanding disc adjacent to its peripheral edge that projects past the foam disc has a tendency to be or become rippled or curled, which rippling or curling appears to be accentuated by humidity fluctuations. Such rippling or curling of that edge portion exacerbates the problems of gouging and catching on projections mentioned above.

DISCLOSURE OF THE INVENTION

The present invention provides a sanding disc generally of the type described above that comprises a polymeric foam disc and an abrasive disc having a diameter larger than that of the foam disc that is adhered to one major surface of the foam disc and includes a layer of abrasive material (e.g., 60 to 180 grit) along its major surface opposite the foam disc that defines a first major surface of the abrasive disc by which a substrate such as drywall compound may be sanded when the sanding disc is rotated by a drive motor while its first major surface is pressed against the substrate. The sanding disc according to the present invention is improved so that it has significantly less tendency to gouge a substrate such as drywall compound to be smoothed even if it is pressed against that substrate with an angle between the surfaces of the substrate and the first major surface of the sanding disc, it has significantly less tendency to catch and be torn on projections above the surface of the substrate, and it restricts rippling or curling of the portion of the abrasive disc adjacent its peripheral edge.

The abrasive disc in the sanding disc according to the present invention includes a circular central portion, with the portion of the first major surface along that central portion being generally planar; and further includes an annular peripheral portion extending from that central portion to the peripheral surface of the abrasive disc. The portion of the first major surface along that annular peripheral portion of the abrasive disc is generally cylindrically convex and the portion of the first major surface along the circular central portion is generally tangent to the portion of the first major surface along the adjacent part of the annular peripheral portion so that the curvature of the annular peripheral portion positions the peripheral surface of the abrasive disc in a plane passing through the foam disc.

This generally cylindrically convex or inversely cupped portion of the first major surface along the annular peripheral portion of the abrasive disc has less tendency to gouge a substrate of drywall compound to be sanded as it is brought into contact with that drywall compound and has less tendency to catch and be torn on projections above the drywall compound than does the planer edge portion of the prior art drywall compound sanding disc described above. Also, this generally cylindrically convex or inversely cupped shape of the annular peripheral portion of the abrasive disc according to the present invention restricts the rippling or curling of the abrasive disc adjacent its peripheral edge which occurs in the prior art drywall compound sanding disc described above.

The portion of the first major surface on the generally cylindrically convex annular peripheral portion of the abrasive disc can, at each location around the annular peripheral portion, be generally circular around an axis (called a peripheral portion axis herein) in a plane parallel to and passing through the axis of the abrasive disc and that location. The radius of the portion of the first major surface on the annular peripheral portion of the abrasive disc around the peripheral portion axis at each location around the annular peripheral portion can be the same radius from the range of about 2 to 7 inches or 5 to 18 centimeters, with a radius of about 6 inches or 15 centimeters having been found to be more effective than either a larger or a smaller radius.

A novel method for forming the sanding disc according to the present invention can include method steps used for forming the prior art drywall compound sanding disc described above, which method steps include (1) providing the polymeric foam disc with the structure described above, and (2) providing an abrasive disc with the structure described above except that it has planar major surfaces, (3) providing a sheet of hot melt adhesive; (4) positioning the sheet of hot melt adhesive between a major surface of the abrasive disc opposite its layer of abrasive material and one major surface of the foam disc with the discs coaxial; and (5) heating and pressing together the positioned abrasive disc, sheet of hot melt adhesive, and foam disc to soften the sheet of hot melt adhesive and cause it to adhere the abrasive and foam discs together when the sanding disc cools. Additionally, the method according to the present invention includes the steps of (6) heating an originally generally planar annular peripheral portion of the abrasive disc extending from a planar central portion of the abrasive disc to the peripheral surface of the abrasive disc, and (7) reshaping the heated originally generally planar annular peripheral portion of the abrasive disc so that, after the abrasive disc cools, the portion of the first major surface defined by the layer of abrasive along that annular peripheral portion of the abrasive disc is generally cylindrically convex with the portion of the first major surface along the circular planar central portion being generally tangent to the adjacent part of the first major surface along the annular peripheral portion. Such generally cylindrically convex curvature of the first major surface along the annular peripheral portion positions the peripheral surface of the abrasive disc in a plane passing through the foam disc.

We are not sure why that the generally cylindrically convex shape of the first major surface along the annular peripheral portion is retained after the abrasive disc cools, but speculate that during the heating, shaping, and cooling of the abrasive disc (e.g., heating at 375 degrees Fahrenheit or 190 degrees Centigrade for 30 seconds while shaping the abrasive disc and then cooling at ambient temperature) latex in the cloth backing of the abrasive disc is softened when heated and again solidifies when cooled to retain the shape of the backing in the manner that starch shapes cloth when the cloth is ironed, and/or that micro-cracks formed when the annular peripheral portion is shaped in a resin layer attaching the abrasive to the backing of the abrasive disc are annealed by the heat applied to the disc; however other factors may also be involved.

While the steps of (6) heating and (7) reshaping the annular peripheral portion of the abrasive disc could be done prior to the step (5) of heating and pressing together the positioned abrasive disc, sheet of hot melt adhesive and foam disc; it is very convenient to perform those steps (6) and (7) during that step (5) by using a specially shaped surface that contacts the abrasive disc on a part of a press by which step (5) is performed.

BRIEF DESCRIPTION OF THE DRAWING

The present invention will be further described with reference to the accompanying drawing wherein like reference numerals refer to like parts in the several views, and wherein.

DETAILED DESCRIPTION

Figure 1:
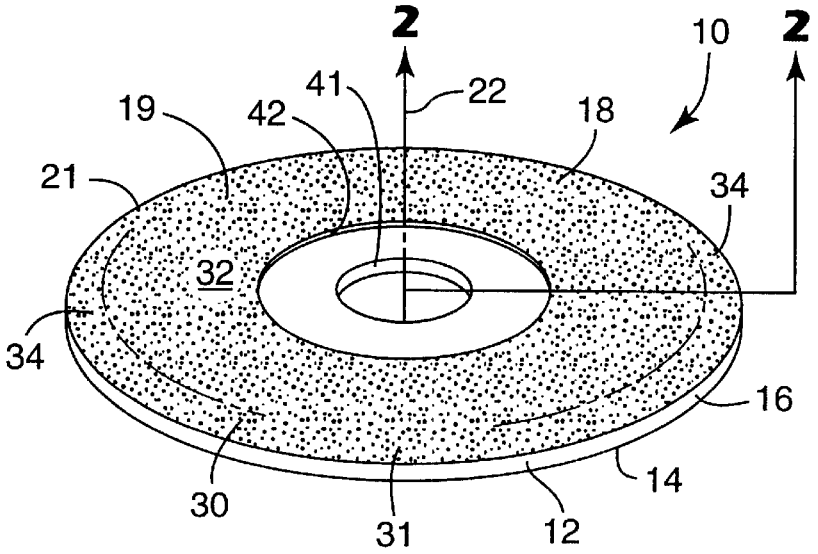
FIG. 1 is a perspective view of a sanding disc according to the present invention.
Figure 2:
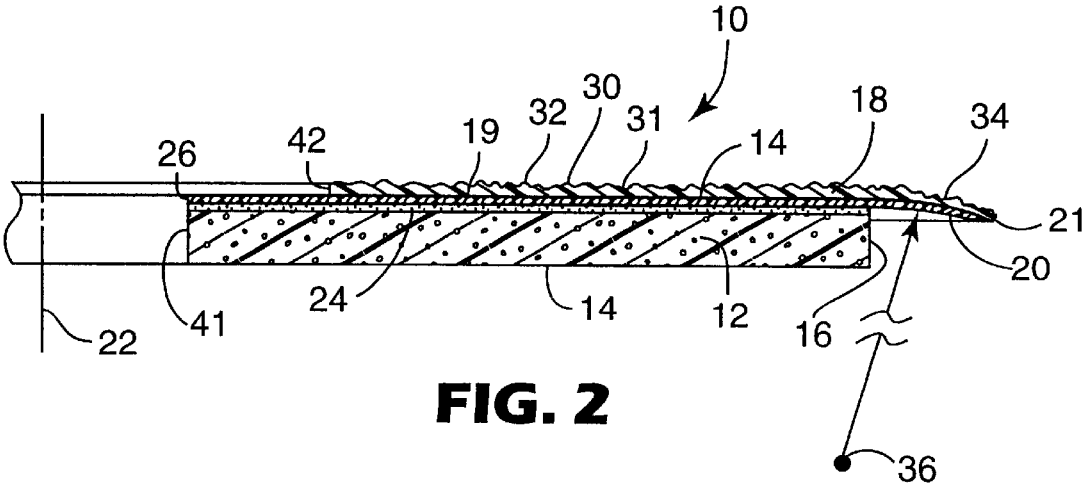
FIG. 2 is an enlarged fragmentary view taken approximately along the line 2—2 of FIG. 1.

Referring now to FIGS. 1 and 2 of the drawing, there is shown a sanding disc according to the present invention, generally designated by the reference numeral 10, that can be used for abrading substrates, particularly including substrates of drywall compound.

Generally, the sanding disc 10 includes a circular foam disc 12 of resiliently compressible foam. The foam disc 12 has an axis, opposite axially spaced major surfaces 14, a predetermined diameter, and a cylindrical peripheral surface 16 about its axis extending between its major surfaces 14. The sanding disc 10 also includes a circular abrasive disc 18 having an axis, opposite first and second axially spaced major surfaces 19 and 20, a peripheral surface 21 about its axis between its major surfaces 19 and 20, and a diameter larger than the diameter of the foam disc 12. The second major surface 20 of the abrasive disc 18 is adhered to one major surface 14 of the foam disc 12 by a layer 24 of hot melt adhesive with the discs 12 and 18 being coaxial about their axes 22. The abrasive disc 18 comprises a layer of backing material 26 (e.g., cloth) having opposite major surfaces, a layer 30 of abrasive material, and a layer 31 of resin adhering the layer of abrasive material along one major surface of the layer of backing material 26 so that the layer 30 of abrasive material defines the first major surface 19 of the abrasive disc 18. The abrasive disc 18 includes a circular central portion 32, with the portion of its first major surface 19 along that central portion being generally planar. The abrasive disc 18 also includes an annular peripheral portion 34 extending from its central portion 32 to its peripheral surface 21, with the portion of its first major surface 19 along that annular peripheral portion 34 being generally cylindrically convex and with the portion of the first major surface 19 along the planer circular central portion 32 being generally tangent to the adjacent part of the first major surface 19 along the annular peripheral portion 34 (i.e., the portion of its first major surface 19 along adjacent parts of its circular central and annular peripheral portions 32 and 34 are generally in the same plane) so that the curvature of the generally cylindrically convex annular peripheral portion 34 positions the peripheral surface 21 of the abrasive disc 10 in a plane passing through the foam disc 12.

As is best illustrated in FIG. 2, the portion of the first major surface 19 along the annular peripheral portion 34 of the abrasive disc 18 is, at each location around the annular peripheral portion 34, generally circular around a peripheral portion axis 36 in a plane parallel to and passing through the axis 22 of the abrasive disc 10 and that location. The radius around the peripheral portion axis 36 of the portion of the first major surface 19 on the annular peripheral portion 34 of the abrasive disc 18 at each location around the annular peripheral portion 34 can be the same radius from within the range of about 2 to 7 inches or 5 to 18 centimeters, with one especially effective radius being about 6 inches or 15 centimeters. As that radius drops below 6 inches or 15 centimeters there is increasingly more tendency for part of the first major surface 19 along the annular peripheral portion 34 of the abrasive disc 18 that is adjacent the planar circular central portion 32 to gouge dry wall compound being smoothed by the sanding disc 10, which tendency becomes quite significant when that radius drops below 2 inches (i.e., below 2 inches the sharp radius provides too much of a ridge-like shape along that part of the first major surface 19). As that radius increases above 6 inches or 15 centimeters there is increasingly more tendency for the first major surface 19 along part of the annular peripheral portion 34 of the abrasive disc 18 adjacent its peripheral surface 16 to gouge dry wall compound being smoothed by the sanding disc 10 and for the annular peripheral portion 34 to catch and be torn on projections above the surface of drywall compound being smoothed by the sanding disc 10, which tendency becomes quite significant when that radius increases above 7 inches (above that radius the portion of first major surface 19 on the annular peripheral portion 34 approaches being planer).

Preferably the circular central portion 32 has an outer diameter smaller than the outer diameter of the foam disc 12

(e.g., in the range of about 0.2 to 0.4 inch or 0.5 to 1 centimeter smaller, with a dimension of about 0.3 inch or 0.8 centimeter smaller being preferred) to minimize gouging of dry wall compound being smoothed by the annular peripheral portion 34 of the sanding disc 10. Toward the lower end of that range support of the annular peripheral portion 34 by the foam disc 12 is less that toward the upper end of that range. Toward the lower end of that range there is an increased possibility that the annular peripheral portion 34 will buckle during use, causing the first major surface 19 along the annular peripheral portion 34 of the abrasive disc 18 adjacent the planar circular central portion 32 to gouge dry wall compound being smoothed by the sanding disc 10. Conversely, toward the upper end of that range increased support of the annular peripheral portion 34 by the foam disc 12 increases the possibility that the first major surface 19 along the annular peripheral portion 34 of the abrasive disc 18 adjacent its peripheral surface 16 will gouge dry wall compound being smoothed by the sanding disc 10.

Figure 3:
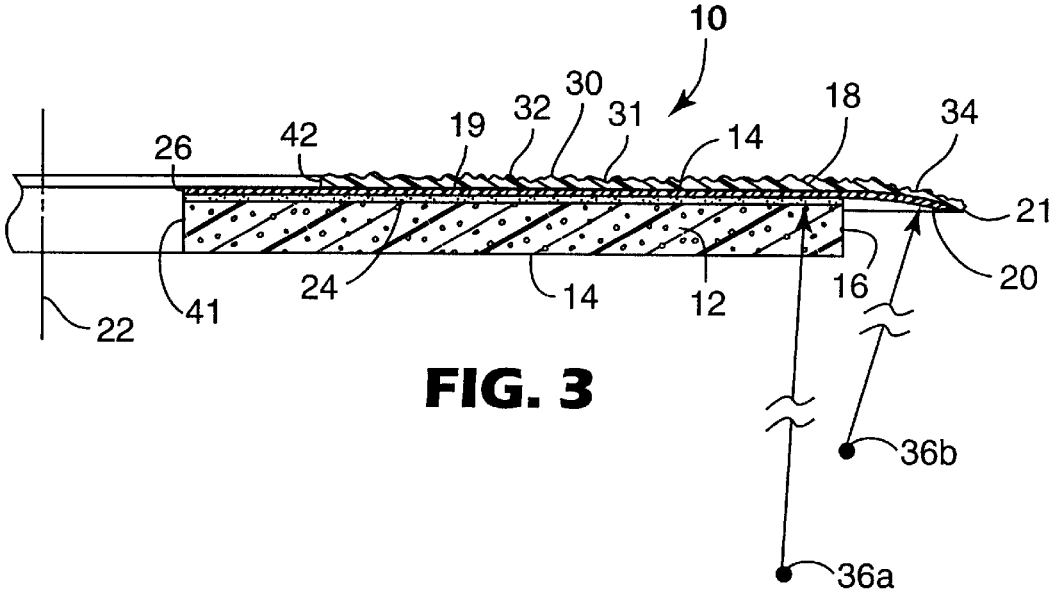
FIG. 3 is an enlarged fragmentary view taken approximately along the line 2—2 of FIG. 1 that only differs from FIG. 2 by illustrating a slightly modified shape for an annular peripheral portion of an abrasive disc included in the sanding disc.

As is illustrated in FIG. 3, the portion of the first major surface 19 along the annular peripheral portion 34 of the abrasive disc 18 could, at each location around the annular peripheral portion 34, be generally circular or arcuate around more than one peripheral portion axis in a plane parallel to and passing through the axis 22 of the abrasive disc 10 and that location, such as the two axes 36*a* and 36*b* illustrated. As an example, the radius around the peripheral portion axis 36*a* of the portion of the first major surface 19 on the annular peripheral portion 34 of the abrasive disc 18 adjacent its planar circular central portion 32 could be in the range of about 5 to 7 inches or 12.7 to 18 centimeters so that there would be little ridge-like shape along that part of the annular peripheral portion 34 of the abrasive disc 18 that could gouge dry wall compound being smoothed by the sanding disc 10, and the radius around the peripheral portion axis 36*b* of the portion of the first major surface 19 on the annular peripheral portion 34 of the abrasive disc 18 adjacent its peripheral surface 16 could be in the range of about 2 to 6 inches or 5 to 15.3 centimeters so that there will be little tendency for the first major surface 19 along part of the annular peripheral portion 34 of the abrasive disc 18 adjacent its peripheral surface 16 to gouge dry wall compound being smoothed by the sanding disc 10 or for the annular peripheral portion 34 to catch and be torn on projections above the surface of drywall compound being smoothed by the sanding disc 10. There would also be a smooth arcuate transition of the first major surface 19 along the annular peripheral portion 34 between those parts.

Thus, by saying that the portion of the first major surface 19 along the annular peripheral portion 34 is generally cylindrically convex we include the possibility that different parts of that portion of the first major surface 19 are generally circular or arcuate around different peripheral portion axes; and also, of course, include generally cylindrically convex shapes that are curved into an annulus around the periphery of the abrasive disc 18.

To facilitate fastening the sanding disc 10 to a drive mechanism for rotating the sanding disc 10 about its axis while its first major surface 19 is pressed against a substrate such as drywall compound to smooth it, the foam disc 12 has a through central opening 41 about the axis 22, and the abrasive disc 18 also has a central through opening 42 about the axis 22 that is significantly larger (e.g., 1.875 inches or 4.76 centimeters larger) than the central through opening 41 in the foam disc 12. The sanding disc 10 is supported on a circular flat platen co-axially fixed on a shaft (not illustrated) that can be rotated about its axis by the drive mechanism, which platen has an outer diameter that has about the same dimension as the outer diameter of the foam disc 12, and has a short cylindrical projection that will project into and fits closely within the central opening 41 in the foam disc 12 to concentrically center the sanding disc 10 on the platen. The disc 10 is then releasably clamped to the platen by a washer like retainer (also not illustrated) that has a diameter larger than the opening 41 in the foam disc 12, but slightly smaller than the central opening 42 in the abrasive disc 18. The washer like retainer has a portion that threadably engages the central shaft on which the platen is fixed to compress a central ring of the foam disc 12 against the platen, and is sufficiently thin that when so engaged its outer surface opposite the platen does not project above the first major surface 19 along the circular central portion 32 of the abrasive disc 10.

Suitable materials and sizes for the sanding disc 10 include the following. The foam disc 12 can have a diameter at its peripheral surface 16 of 8.25 inches or 20.96 centimeters, a thickness of 0.625 inch or 1.59 centimeters between its surfaces 14, and a central through opening 41 having a diameter of 2.125 inches or 5.4 centimeters; and can be made of an open cell foam that is a blend of polyurethane and polyether and has a density in the range of about 1.6 to 1.8 pounds per cubic foot and an IFD (Indentation Load Deflection–25%IFD @4×15×15) of 60 to 70 as measured on a PTC sponge rubber gage, model 3025, commercially available from Pacific Transducer Corp., Los Angeles, Calif. The abrasive disc 18 can have a diameter at its peripheral surface 21 of 8.875 inches or 22.54 centimeters and a central through opening 42 having a diameter of 4 inches or 10.16 centimeters, and can be cut from a sheet of the abrasive material available from Minnesota Mining and Manufacturing Company, St. Paul, Minn., under the commercial designation "3MITE resin bond abrasive" which has either an X weight or a J weight full flex cloth backing, and has an abrasive grit size generally in the range of 80 to 150 or 60 to 200. The layer 24 of hot melt adhesive can be (before application) a 0.0035 inch or 0.009 centimeter thick layer of the hot melt adhesive commercially available under the trade designation "Dow 916 Film" from Dow Chemical Company, Midland, Mich., having an outer diameter about equivalent to that of the foam disc 12 (i.e. about 8.25 inches or 20.96 centimeters) and an inner diameter about equivalent to the diameter of the central through opening 42 in the disc 18 (i.e., about 4 inches or 10.16 centimeters) so that it corresponds to the overlap of the foam disc 12 and abrasive disc 18.

Figure 4:
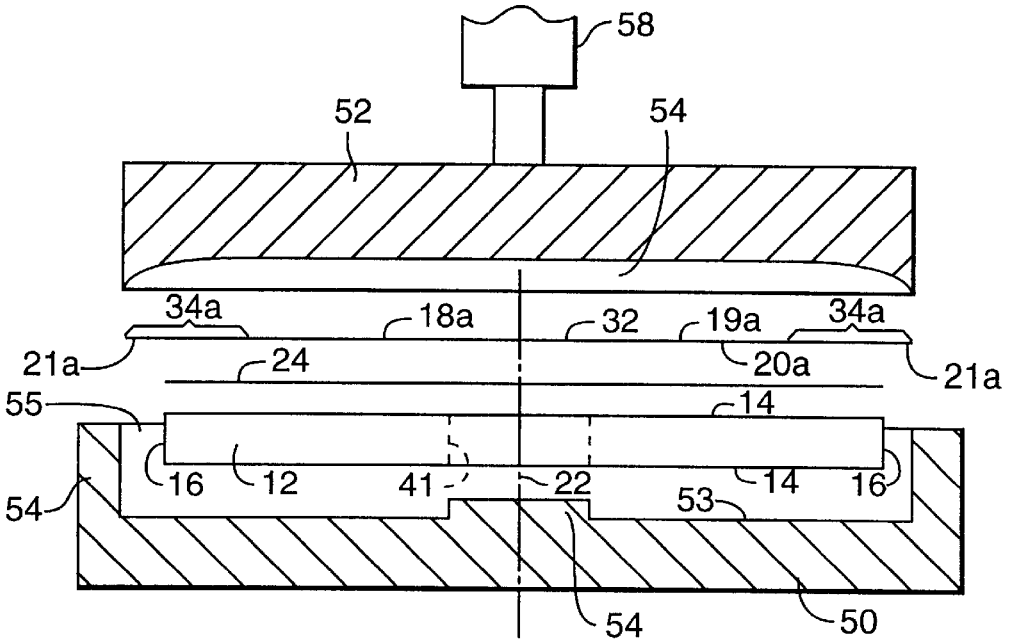
FIG. 4 is a partially sectioned view schematically illustrating a method according to the present invention for making the sanding disc shown in FIGS. 1 and 2.

A method for forming the sanding disc 10 is illustrated in FIG. 4. That method comprising the steps of providing, as separate elements, the circular foam disc 12 and the layer 24 of hot melt adhesive 24 described above, together with an abrasive disc 18*a* that has the same structure as the abrasive disc 18 described above, except that its first major surface 19*a* is entirely planar (i.e., a circular sheet of planar abrasive material as is conventionally supplied by a manufacturer, such as one of those indicated above). The abrasive disc 18*a*, layer 24 of hot melt adhesive and foam disc 12 are heated and pressed together as by a press having spaced lower and upper platens 50 and 52. The lower platen 50 has a planar support surface 53 adapted to support the foam disc 12 and a central cylindrical upwardly projecting projection 54 adapted to project into the central opening 41 in the foam disc 12 to center it on the support surface 53. The lower platen 50 also has an annular upwardly projecting peripheral wall 54 with a cylindrical inner surface 55 sized to center the abrasive disc 18*a* co-axially with the foam disc 12. The upper platen 52 can be selectively moved toward and away from the lower platen 50 by means such as a hydraulic piston assembly 58 and is heated by electrical means so that when the abrasive disc 18*a*, layer 24 of hot melt adhesive, and foam disc 12 are pressed together it will cause the layer 24 of hot melt adhesive to soften and adhere the foam disc 12 to the abrasive disc 18*a* when the sanding disc 10 cools. Simultaneously, the abrasive disc 18*a* is heated, and the abrasive disc 18*a* is pressed by an inner surface 54 on the platen 52 that is shaped to cause the abrasive disc 18*a* to retain the circular central portion 32 having a diameter smaller than the diameter of the foam disc 12, with the portion of the first major surface 19 along the central portion 32 being generally planar, while reshaping an annular peripheral portion 34*a* of the abrasive disc 18 extending from its central portion 32 to its peripheral surface 21, so that the portion of the first major surface 19*a* of the abrasive disc 18*a* along that peripheral portion 34*a* changes from planar to generally cylindrically convex with the portion of the first major surface 19 along the planer circular central portion 32 being generally tangent to the portion of the first major surface 19 along the adjacent part of the annular peripheral portion 34 as is illustrated in FIGS. 1 and 2. As an example, the positioned abrasive disc 18*a*, layer 24 of hot melt adhesive and foam disc 12 can be heated at about 375 degrees Fahrenheit or 190 degrees Centigrade for about 30 seconds while being pressed together by the platens 50 and 52 spaced at 0.20 inch or 0.5 centimeter by the height of the projection 54 and then cooled at ambient temperature to form the abrasive disc 10.

The present invention has now been described with reference to one embodiment and possible modifications thereof. It will be apparent to those skilled in the art that many changes can be made in the embodiments described or the method for making the embodiment described without departing from the scope of the present invention. Also, the present invention may be useful for sanding substrates other than drywall compound, such as, for example, coats of paint on a wall or hardwood floors. Thus, the scope of the present invention should not be limited to the structures methods or uses described in this application, but only by the structures described by the language of the claims and the equivalents thereof.

What is claimed is:

1. A sanding disc comprising:

a polymeric foam disc of resiliently compressible foam, said foam disc having an axis, opposite axially spaced major surfaces, a predetermined diameter, and a peripheral surface about said axis extending between said major surfaces;

an abrasive disc having an axis, opposite first and second axially spaced major surfaces, a peripheral surface about said axis between said major surfaces, and a diameter larger than the diameter of said foam disc, the second major surface of said abrasive disc being adhered to one major surface of said foam disc with said discs being coaxial, and said abrasive disc comprising a layer of backing material having opposite major surfaces, a layer of abrasive material, and a layer of resin adhering said layer of abrasive material along the major surface of said layer of backing material opposite said foam disc with said layer of abrasive material defining the first major surface of said abrasive disc, said abrasive disc including a circular central portion having an outer diameter smaller than the outer diameter of said foam disc, with a portion of said major surface along said central portion being generally planar, and said abrasive disc including an annular peripheral portion extending from said central portion to said peripheral surface of said abrasive disc, with a portion of said first major surface along said annular peripheral portion being generally cylindrically convex with the portion of the first major surface along the planer circular central portion being generally tangent to the adjacent part of the portion of the first major surface along the annular peripheral portion so that the curvature of the annular peripheral portion positions said peripheral surface of said abrasive disc in a plane passing through said foam disc.

2. A sanding disc according to claim 1 wherein the portion of said first major surface on the annular peripheral portion of said abrasive disc is, at each location around said annular peripheral portion, generally circular around a peripheral portion axis in a plane parallel to and passing through the axis of said abrasive disc and said each location.

3. A sanding disc according to claim 2 wherein the radius of the portion of said first major surface on the annular peripheral portion of said abrasive disc around said peripheral portion axis at each location around said annular peripheral portion is in the range of about 2 to 7 inches or 5 to 18 centimeters.

4. A sanding disc according to claim 2 wherein the radius of the portion of said first major surface on the annular peripheral portion of said abrasive disc around said peripheral portion axis at each location around said annular peripheral portion is about 6 inches or 15 centimeters.

5. A sanding disc according to claim 1 wherein said circular central portion has an outer diameter smaller than the outer diameter of said foam disc.

6. A sanding disc according to claim 1 wherein said foam disc and said abrasive disc each have a central through opening about said axis with the central through opening in said abrasive disc being significantly larger than the central through opening in said foam disc.

7. A sanding disc according to claim 1 wherein said layer of backing material in said abrasive disc is of cloth.

8. A sanding disc according to claim 1 wherein said abrasive material in said abrasive disc has a grit size generally in the range of 60 to 200.

* * * * *

UNITED STATES PATENT AND TRADEMARK OFFICE

CERTIFICATE OF CORRECTION

PATENT NO. : 6,530,830 B2
DATED : March 11, 2003
INVENTOR(S) : Rich, Larry D.

It is certified that error appears in the above-identified patent and that said Letters Patent is hereby corrected as shown below:

Column 4,
Line 13, after "layer" insert -- 30 --

Column 5,
Line 35, delete "," and insert -- ; --

Signed and Sealed this

Twenty-seventh Day of July, 2004

JON W. DUDAS
*Acting Director of the United States Patent and Trademark Office*